US005148754A

United States Patent [19]

Lahti et al.

[11] Patent Number: 5,148,754

[45] Date of Patent: Sep. 22, 1992

[54] CARRIAGE LOCK FOR A MOBILE STORAGE SYSTEM WITH ROTATABLE ACTUATOR KNOB

[75] Inventors: Richard Lahti, Fond du Lac; Kent Thomas, Mayville, both of Wis.

[73] Assignee: Tab Products Company, Palo Alto, Calif.

[21] Appl. No.: 667,653

[22] Filed: Mar. 11, 1991

[51] Int. Cl.[5] ..... B61C 9/00; E05B 13/10

[52] U.S. Cl. ..... 105/96; 105/101; 188/31; 188/69; 70/210; 292/359; 312/198

[58] Field of Search ..... 105/96, 101, 127; 188/31, 60, 69, 265; 70/207, 209, 210, 211, 212, 215, 216, 217; 292/359, DIG. 27; 312/198, 200, 201

[56] References Cited

U.S. PATENT DOCUMENTS

| | | | |
|---|---|---|---|
| 1,707,458 | 4/1929 | Clench | 188/31 X |
| 1,853,110 | 4/1932 | Ball | 188/69 |
| 4,138,173 | 2/1979 | Taniwaki | 312/198 |
| 4,153,312 | 5/1979 | Taniwaki | 188/31 X |
| 4,256,355 | 7/1979 | Yamaguchi et al. | 312/198 |
| 4,280,595 | 7/1981 | Timms et al. | 188/31 |
| 4,523,794 | 6/1985 | Peterman | 70/210 X |
| 4,527,680 | 7/1985 | Sato | 70/209 X |

*Primary Examiner*—Robert J. Oberleitner
*Assistant Examiner*—S. Joseph Morano
*Attorney, Agent, or Firm*—Donald Cayen

[57] ABSTRACT

A carriage lock selectively enables and prevents a mobile carriage from moving along rails embedded in a building floor. The mobile carriage includes a shaft on which are rotatably mounted a driver sprocket, a hub, and a handwheel. The hub mates with the driver sprocket. A chain and sprocket mechanism connects the driver sprocket with the carriage wheels such that rotation of the handwheel and hub causes the carriage to move along the rails. A locking knob is loosely captured between the hub and handwheel for being manually rotated through a predetermined angle relative to the hub and handwheel. A pin is translatable within the hub parallel to the shaft longitudinal axis. The pin has a head that is received within a selected one of two angularly spaced depressions in a cam formed on the locking knob. The depressions are also spaced apart in the direction of the shaft longitudinal axis. By rotating the locking knob through the predetermined angle to first and second positions, the cam translates the pin in the hub between respective first and second positions. In the first position, the pin engages a lock plate held stationarily to the shaft to thereby prevent rotation of the hub and handwheel and thus prevent carriage movement. Rotating the locking knob to the second position thereof translates the pin to disengage from the lock plate and thereby enables the hub and handwheel to be rotated to move the carriage.

27 Claims, 3 Drawing Sheets

CARRIAGE LOCK FOR A MOBILE STORAGE SYSTEM WITH ROTATABLE ACTUATOR KNOB

BACKGROUND OF THE INVENTION

1. Field of the Invention

This invention pertains to mobile storage systems, and more particularly to apparatus for controlling the movement of mobile carriages.

2. Description of the Prior Art

It is well known to combine storage shelves with carriages that move along floor mounted rails. Such mobile storage units enable large quantities of materials to be stored in relatively small spaces while still providing easy access to all the stored items. Consequently, mobile storage systems that employ several mobile carriages are in widespread use in offices and libraries.

A mobile carriage and its load of books, papers, and other items may weigh several hundred pounds. Consequently, an electric power drive or a manual drive having a large mechanical advantage is usually employed to move the carriage along the rails without excessive human effort. Manually powered mobile storage systems normally include a handwheel located at one end of each carriage. The handwheel is typically linked to a chain and sprocket mechanism that connects with drive wheels in contact with the rails. By rotating the handwheel, the chain and sprocket mechanism operates to move the carriage along the rails independently of the other carriages in the system. Accordingly, aisles are created or dissipated between two adjacent carriages by causing the carriages to move toward or away from each other. When two adjacent carriages are separated from each other, a person can walk in the aisle between them to gain access to the materials stored within either carriage.

For safety purposes, it is desirable that the carriages not be movable when a person is standing in the aisle between them. For that reason, various types of locking devices have been developed to selectively prevent carriage movement along the rails. One type of prior lock employs pins that are actuable to enter between and withdraw from adjacent links of a chain of the chain and sprocket mechanism, The pins are housed in blocks fixed to the carriage frame such that engaging a chain with the pins prevents chain travel and thus carriage movement. A somewhat similar prior locking device uses two clamps that engage and disengage selected chain lengths between them. The clamps are mounted to the carriage frame, so carriage movement is prevented when the clamps engage the chain.

Although the prior locking devices are generally satisfactory, they nevertheless are subject to improvement.

SUMMARY OF THE INVENTION dance with the present invention, a simple and reliable carriage lock is provided that selectively prevents movement of a heavy mobile carriage. This is accomplished by an apparatus that includes a hub rotatably mounted on a fixed shaft and a pin received in the hub that selectively engages and disengages a lock plate stationarily held on the shaft.

The shaft is welded or otherwise fixed to a sturdy plate that forms a part of the mobile carriage. An elongated bushing is rotatable on the shaft. Pressed on one end of the bushing is a sprocket with a driving flat. A chain is trained over the sprocket. The chain meshes with drive components that are connected to one or more of the carriage wheels, as is known in the art.

The hub is received on the second end of the bushing and has a central bore that is concentric with the shaft axis. A retainer ring on the end of the shaft retains the hub axially to the shaft while permitting the bushing and hub to rotate on the shaft. The hub has a drive flat that matches the drive flat on the sprocket. Rotation of the hub therefore rotates the sprocket and drives the chain to move the carriage along the rails.

To rotate the hub and thus move the mobile carriage with ease, the hub is fastened to a handwheel. The handwheel preferably has an annular ring that surrounds and is concentric with the periphery of a flange of the hub. Radially extending screws fasten the handwheel ring to the hub flange.

Captured loosely between the handwheel and the hub is a locking knob. The locking knob is capable of being manually rotated through a predetermined angle about the shaft axis relative to the hub and handwheel. Such rotation is governed by the cooperation of an annular cutout in the locking knob and a stop pin pressed into the hub. The stop pin accosts the sides of the locking knob cutout to limit the angular rotation thereof.

The locking knob is designed with a cam having first and second detents and a ramp surface between the two detents. The detents are angularly spaced apart a distance equal to the predetermined angular motion of the locking knob. Further, the detents are spaced apart in the longitudinal direction of the shaft axis. The detents are located and sized to receive the head of a pin that is received in a second bore in the hub. The longitudinal axis of the hub second bore is parallel to and radially spaced from the shaft longitudinal axis. The pin is biased out of the hub second bore by a spring such that the pin head is always urged into contact with the locking knob cam. Accordingly, rotation of the locking knob within the handwheel and hub causes the pin to translate axially within the hub second bore.

The locking knob is rotatable to a first position at which the pin head enters the first cam detent. In that situation, the pin is forced axially further into the hub second bore against the spring. Rotation of the locking knob to a second position at the predetermined angular rotation from the first position enables the spring to translate the pin in the opposite direction out of the hub bore and causes the pin head to enter the second cam detent.

When the pin head is received in the cam first detent by turning the locking knob to the first position thereof, a neck in the pin is radially aligned with and clears the lock plate stationarily held on the shaft. With the pin neck aligned with the lock plate, the handwheel and hub are free to rotate relative to the shaft and lock plate for moving the carriage. On the other hand, when the locking knob is turned to the second angular position thereof and the pin head enters the second cam detent, a body portion of the pin becomes radially aligned with and engages the lock plate. Such engagement between the pin body and the lock plate prevents rotation of the hub and handwheel on the shaft and therefore prevents movement of the carriage along the rails. In that manner, the carriage is selectively enabled and prevented from moving by manual rotation of the locking knob.

Other advantages, benefits, and features of the invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
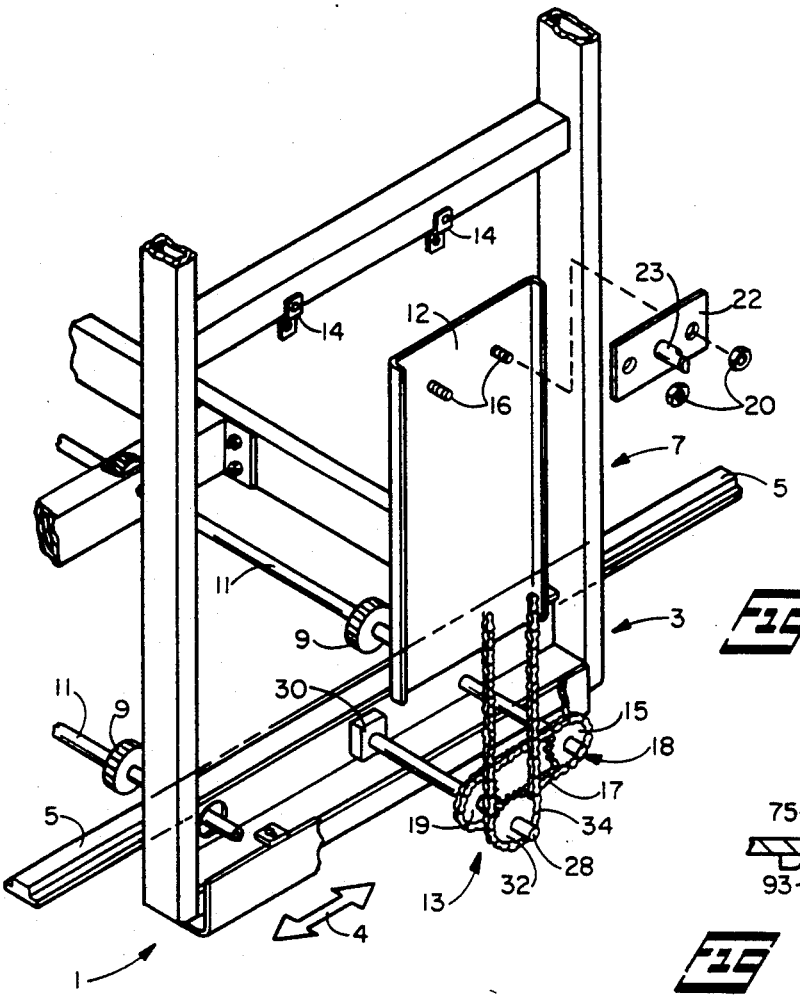
FIG. 1 is an exploded perspective view of a portion of a mobile carriage that advantageously includes the present invention.

Referring to FIG. 1, a portion of a mobile storage system 1 is illustrated that includes the present invention. The mobile storage system 1 includes one or more mobile carriages 3. The mobile carriages 3 roll longitudinally in the directions of arrow 4 along parallel rails 5, only one of which is shown in FIG. 1, embedded in the floor of an office or library.

Each mobile carriage 3 of the mobile storage system 1 is comprised of a sturdy frame 7 that is rollingly supported on the rails 5 by means of wheels 9 and axles 11. The particular carriage 3 illustrated also includes a panel 12 that is fastened to the frame 7 by clips 14 and conventional fasteners, not shown.

The mobile carriage 3 is propelled along the rails 5 by a manual drive system 13 that includes a chain and sprocket drive 18. Typically, one of the axles 11 has a sprocket 15 mounted thereon. A chain 17 is trained over the sprocket 15. The chain 17 is also trained over a similar sprocket 19 that is connected to an intermediate shaft 28. The intermediate shaft 28 mounts by conventional bearings and housings 30 to the frame 7. Also connected to the intermediate shaft is a driven sprocket 32. A second chain 34 is trained over the driven sprocket 32.

Figure 2:
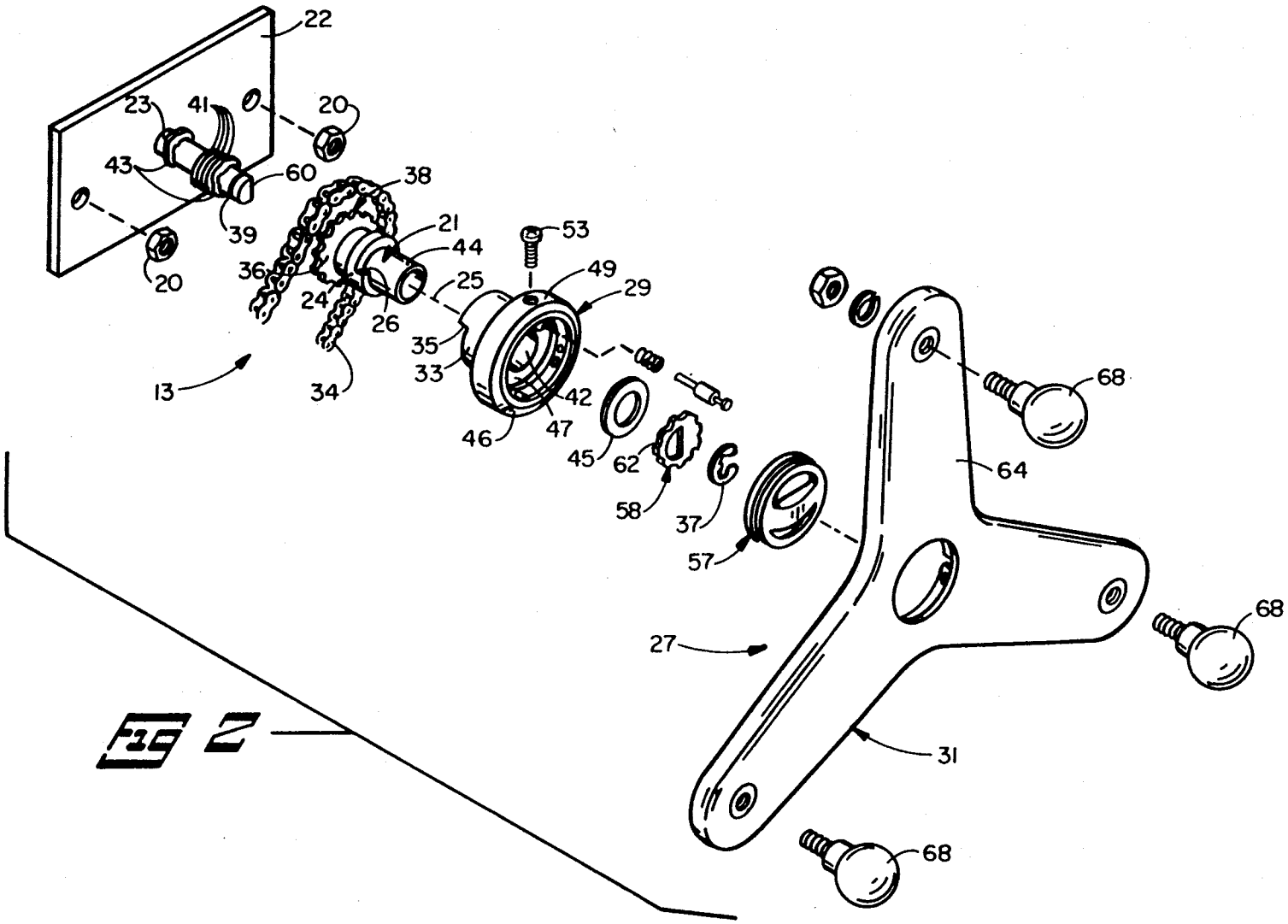
FIG. 2 is an exploded perspective view of the carriage lock of the present invention in conjunction with a portion of a manual drive system for the mobile carriage.
Figure 3:
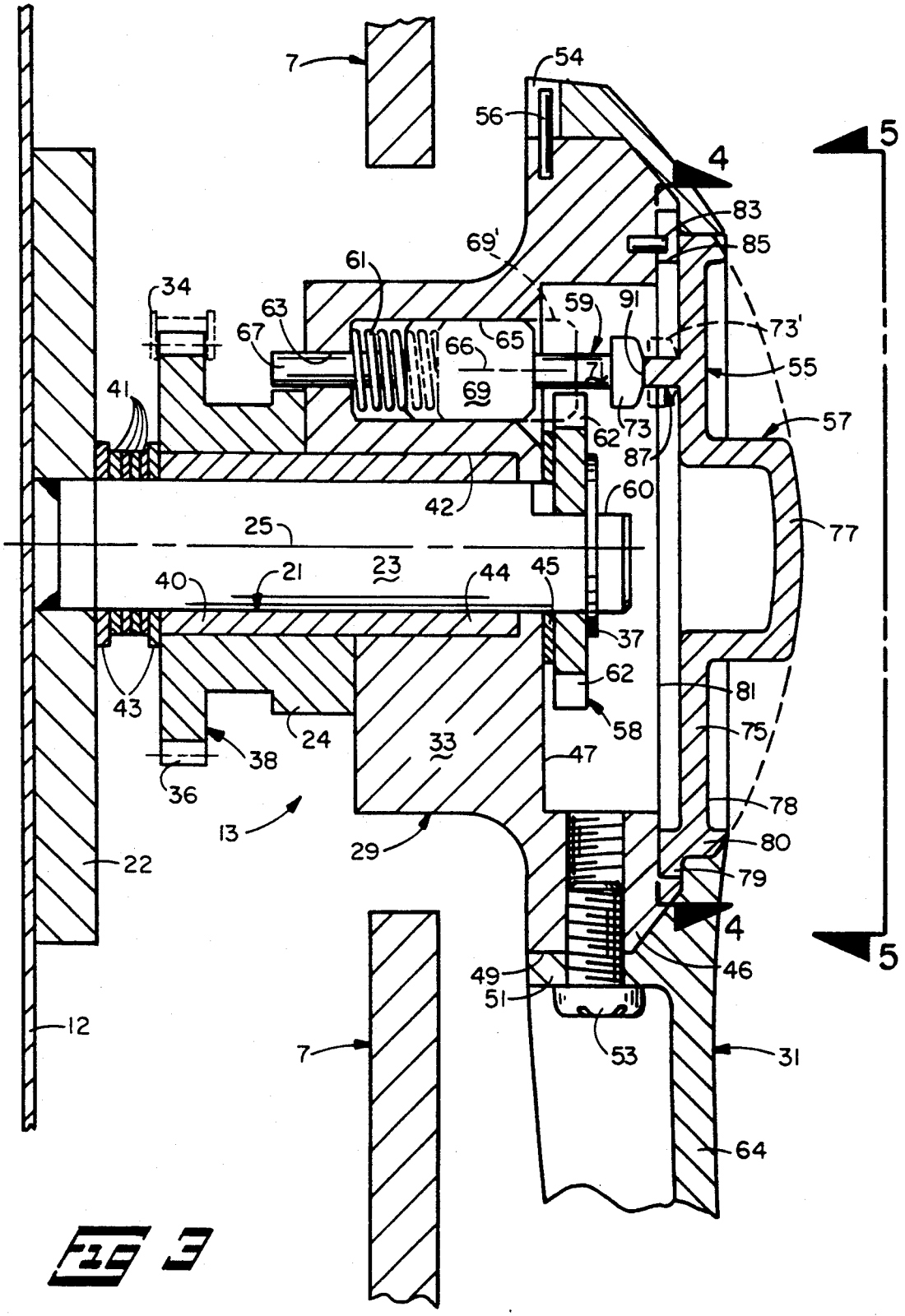
FIG. 3 is an enlarged longitudinal cross sectional view of the carriage lock of the present invention in the assembled condition.

Looking also at FIGS. 2 and 3, the chain 34 of the chain and sprocket drive 18 is also trained over the teeth 36 of a driver sprocket 38. The driver sprocket 38 is manufactured with a tubular section 24, on the end of which is formed a diametrical drive flat 26. To rotatingly support the driver sprocket 38, the carriage drive system 13 further comprises a shaft 23 that is welded or otherwise fixed with its longitudinal axis 25 generally horizontal to a mounting plate 22. In turn, the mounting plate 22 is secured to the panel 12, as by studs 16 and nuts 20. The driver sprocket 38 is pressed onto one end of a bushing 21 that is rotatable on the shaft 23.

To rotate the driver sprocket 38, the drive system 13 includes a hub 29 and a handwheel 31. The hub 29 has a tubular section 33 with a bore 42. The hub bore 42 is concentric with the shaft axis 25 and is slidable along the second end 44 of the bushing 21. The end of the hub tubular section 33 has a diametrical drive flat 35 that mates with the drive flat 26 of the driver sprocket 38.

To retain the driver sprocket 38 and hub 29 on the shaft 23, a retainer ring 37 is employed in conjunction with a groove 39 in the free end of the shaft. In addition to the driver sprocket and the hub, other components retained on the shaft by the retainer ring 37 include a pair of wavy washers 43 and several nylon washers 41 interposed therebetween. The nylon washers 41 and the wavy washers 43 are placed between the mounting plate 22 and the driver sprocket 38. Another nylon washer 45 is placed against a recessed face 47 of the hub 29 on the opposite end thereof as the drive flat 35. A lock plate 58 is placed between the nylon washer 45 and the retainer ring 37. The lock plate 58 is formed with teeth 62 around its periphery. The free end of the shaft 23 is machined with a flat 60. The lock plate 58 has a generally D shaped bore that matches the periphery of the shaft at the flat 60. Consequently, the lock ring is non-rotatable on the shaft. It is thus seen that the retainer ring cooperates with the shaft groove 39 to hold the driver sprocket 38; hub 29; washers 41, 43, and 45; and lock plate 58 on the shaft 23. It is further seen that rotating the handwheel causes identical rotation of the hub and driver sprocket 38 to power the chain and sprocket drive 18 and thus move the carriage 3 along the rails 5.

The hub 29 has a flange 46 with an outer periphery 49. The handwheel 31 has an annular ring 51. One or more spokes 64 extend radially from the handwheel ring 51. A hand knob 68 is fastened to the outer end of each spoke 64. The handwheel ring 51 fits over the hub flange periphery 49, and the handwheel is fastened to the hub by radially extending screws 53. To assist aligning the holes in the handwheel and hub for the screws 53, the handwheel ring 51 is cut out with a notch 54. A locating pin 56 is pressed into the periphery 49 of the hub 29. When the handwheel ring is fit onto the hub flange 46 and the locating pin 56 is within the notch 54, the associated holes in the handwheel and hub for the respective screws 53 are aligned with each other.

In accordance with the present invention, the mobile carriage 3 is stoppable at any location along the rails 5 in a safe and positive manner by selective operation of a carriage lock 55. The carriage lock 55 is comprised of a locking knob 57, a pin 59, a spring 61, and the lock plate 58. The tubular section 33 of the hub 29 is provided with a bore 63 and counterbore 65 that are concentric with an axis 66 that is radially displaced from the central axis 25. The pin 59 has an extension 67 that slidingly fits within the hub bore 63. The pin further has a body 69 that slidingly fits within the hub counterbore 65. Projecting from the pin body 69 opposite the extension 67 is a neck 71. A head 73 is formed on the free end of the pin neck 71. The spring 61 is interposed between the pin body 69 and the end of the hub counterbore 65 such that the spring tends to force the pin out of the hub counterbore, that is, to the right in FIG. 3.

Figure 4:
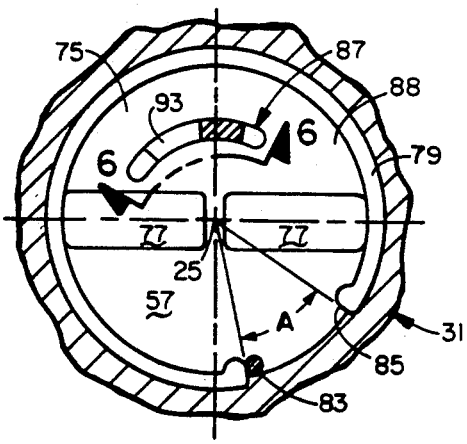
FIG. 4 is a view on a reduced scale taken along lines 4—4 of FIG. 3.

In the illustrated construction, the locking knob 57 is manufactured as a generally flat disk 75 with a diametrically extending ridge 77 projecting from one face 78 of the disk. The periphery of the disk 75 is formed with an L shaped flange 80 having an annular leg 79. The annular leg 79 is loosely captured between the handwheel 31 and a face 81 of the hub flange 46. The locking knob is manually rotatable by means of the ridge 77 about the axis 25 independently of and relative to the handwheel and hub 29. Rotation of the locking knob relative to the hub and handwheel is limited to a predetermined angle, such as approximately 35 degrees, by the cooperation of a stop pin 83 pressed into the hub face 81 and a cutout 85 in the locking knob. The cutout 85 is formed in a portion of the flange 80, and the cutout preferably subtends an angle A of slightly more than 35 degrees. Also see FIG. 4. For clarity, the stop pin 83 and cutout 85 are shown out of position in FIG. 3.

In the preferred embodiment, the locking knob 57 is further formed with an arcuate cam 87 on the disk face 88 opposite the face 78. The cam 87 is located at the same radial distance from the central axis 25 as the axis 66 of the hub 29. Further, the cam is angularly located relative to the locking knob cutout 85 such that the ca is centered angularly on the hub axis 66 when the cutout 85 is centered angularly on the hub stop pin 83.

Figure 6:
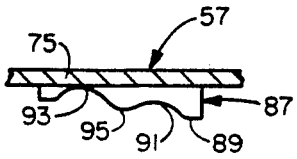
FIG. 6 is a cross sectional view taken along lines 6—6 of FIG. 4.

Looking also at FIG. 6, the cam 87 has a profile 89 that includes two depressions 91 and 93 that ar angularly displaced approximately 35 degrees and also that are axially displaced from each other in the direction parallel to axes 25 and 66. A ramp 95 joins the two depressions 91 and 93. The two depressions are contoured to receive the end of the head 73 of the pin 59. Accordingly, manually oscillating the locking knob 35 degrees by means of the ridge 77 causes the pin head 73 to ride along the cam ramp 95 and enter one or the other of the cam depressions. Thus, the two depressions act as detents for the pin. In FIG. 3, the locking knob 57 is shown rotated to a first position such that the pin head 73 is in the detent formed by the cam depression 91. Also see FIG. 5, wherein the locking knob ridge is in the position shown by the solid line 77. The pin 59 and cam 87 are so dimensioned that in that situation the pin neck 71 is radially aligned with the lock plate 58. Thus, with the pin engaged in the depression 91, rotation of the handwheel 31 and hub 29 is uninhibited, that is, a person can turn the handwheel about axis 25 by means of the knobs 68 and thereby rotate the hub and the driver sprocket 38 to drive the remainder of the drive mechanism 13 and move the carriage 3 along the rails 5.

To prevent rotation of the handwheel 31 and thus prevent movement of the carriage 3, the locking knob 57 is manually rotatable about axis 25 relative to the handwheel and hub 29 to a second position approximately 35 degrees from the first position. The pin head 73 then engages the detent formed by the cam depression 93. The spring 61 in the hub counterbore 65 assures that the pin head properly rides along the cam ramp 95 from the depression 91 to the depression 93 during rotation of the locking knob. With the pin head in engagement with the depression 93, the pin head is in the location indicated by phantom lines 73' in FIG. 3, and the body of the pin is in the location shown by phantom lines 69'. In that situation, the pin body 69' is radially aligned with the non-rotatable lock plate 58, and the pin body has entered between and engaged two teeth 62 of the lock plate. Therefore, rotation of the handwheel is prevented. In that manner, movement of the mobile carriage 3 is selectively prevented by rotation of the locking knob to the second position thereof.

Figure 5:
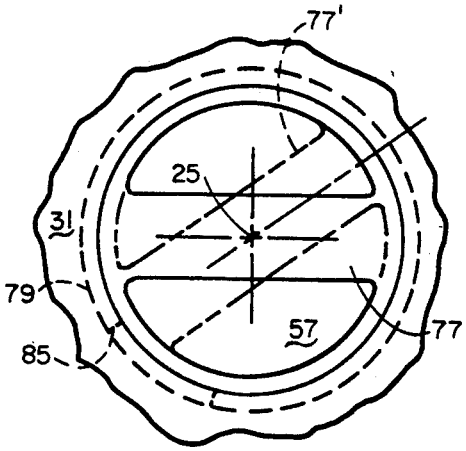
FIG. 5 is a view on a reduced scale taken along lines 5—5 of FIG. 3.

To unlock the carriage lock 55 and enable the mobile carriage 3 to again be moved along the rails 5, it is merely necessary to manually rotate the locking knob 57 back to its first position such that the ridge is at the position indicated by the solid lines 77 of FIG. 5. Such rotation causes the locking knob cam 87 to force the pin 59 into the hub counterbore 65 against the spring 61 such that the pin body returns to the position indicated by the solid line 69 of FIG. 3 and out of engagement with the lock plate 58. Because the spring 61 continually urges the pin head 73 into one or another of the cam depressions 91 and 93, the locking knob 57 rotates together with the handwheel 31 and hub 29 during manual rotation of the handwheel. Only by intentionally rotating the locking knob by means of its ridge 77 can the carriage lock 55 be changed between its locked and unlocked configurations.

Thus, it is apparent that there has been provided, in accordance with the invention, a carriage lock that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A mobile storage system comprising:

a. a plurality of parallel rails embedded in a building floor;

b. a carriage that spans the rails;

c. wheel means for rollingly supporting the carriage on the rails;

d. drive means for manually moving the carriage along the rails, the drive means comprising:

i. a shaft immovably fixed to the carriage and having a longitudinal axis;

ii. hub means mounted on the shaft for rotation about the shaft longitudinal axis; and iii. chain and sprocket means connecting the hub means to the wheel means for moving the carriage along the rails in response to manual rotation of the hub means; and e. lock means for selectively enabling and preventing rotation of the hub means, the lock means comprising:

i. a lock plate held against rotation on the shaft;

ii. pin means translatable within the hub means between a first position whereat the pin means is engaged with the lock plate to prevent rotation of the hub means and a second position whereat the pin means is disengaged from the lock plate to enable rotation of the hub means; and iii. knob means captured within the hub means for being selectively rotated relative thereto to translate the pin means between the first and second positions thereof, so that rotation of the knob means relative to the hub means selectively locks the carriage against movement along the rails and enables carriage movement along the rails.

2. The mobile storage system of claim 1 wherein:

a. the hub means comprises:

i. a hub rotatably mounted on the shaft, the hub defining bore means at a predetermined radial distance from the shaft longitudinal axis for receiving the pin means; and ii. a handwheel fastened to the hub; and b. the pin means comprises:

i. a pin having a body that is slidably received within the hub bore means, a neck having a first end joined to the body and a second end, and a head joined to the neck second end; and ii. biasing means interposed between the pin body and the hub bore means for biasing the pin out of the hub bore means.

3. The mobile storage system of claim 1 wherein:

a. the hub means comprises:

i. a hub rotatably mounted on the shaft, the hub defining bore means at a predetermined radial distance from the shaft longitudinal axis for receiving the pin means; and ii. a handwheel fastened to the hub; and b. the knob means comprises a locking knob captured between the hub and the handwheel and being rotatable relative thereto about the shaft longitudinal axis, the locking knob being formed with cam means in contact with the pin means for translating the pin means between the first and second positions thereof in response to rotation of the locking knob.

4. A mobile storage system comprising:

a. a plurality of parallel rails embedded in a building floor;

b. a carriage that spans the rails;

c. wheel means for rollingly supporting the carriage on the rails;

d. drive means for manually moving the carriage along the rails, the drive means comprising:

i. a shaft fixed to the carriage and having a longitudinal axis;

ii. hub means mounted on the shaft for rotation about the shaft longitudinal axis, said hub means comprising a hub rotatably mounted on the shaft, and a handwheel; and iii. chain and sprocket means connecting the hub means to the wheel means for moving the carriage along the rails in response to manual rotation of the hub means; and e. lock means for selectively enabling and preventing rotation of the hub means, the lock means comprising:

i. a lock plate held against rotation on the shaft;

ii. pin means translatable within the hub means between a first position whereat the pin means is engaged with the lock plate to prevent rotation of the hub means and a second position whereat the pin means is disengaged from the lock plate to enable rotation of the hub means; and iii. knob means rotatably captured within the hub means for selectively translating the pin means between the first and second positions thereof, wherein the knob means comprises a locking knob captured between the hub and the handwheel and being rotatable relative thereto about the shaft longitudinal axis, the locking knob being formed with cam means in contact with the pin means for translating the pin means between the first and second positions thereof in response to rotation of the locking knob, wherein:

the locking knob is formed with an angular cutout that subtends a predetermined angle; and the hub means further comprises a stop pin pressed into the hub and projecting into the locking knob cutout, the hub pin and the locking knob cutout cooperating to limit rotation of the locking knob between first and second positions thereof, the pin means being in the first position thereof when the locking knob is at the first position thereof, and the pin means being in the second position thereof when the locking knob is at the second position thereof, so that rotation of the knob means selectively locks the carriage against movement along the rails and enables carriage movement along the rails.

5. A mobile storage comprising:

a. a plurality of parallel rails embedded in a building floor;

b. a carriage that spans the rails;

c. wheel means for rollingly supporting the carriage on the rails;

d. drive means for manually moving the carriage along the rails, the drive means comprising:

i. a shaft fixed to the carriage and having a longitudinal axis;

ii. hub means mounted on the shaft for rotation about the shaft longitudinal axis, wherein the hub means comprises:

a hub rotatably mounted on the shaft, the hub defining bore means at a predetermined radial distance from the shaft longitudinal axis for receiving the pin means; and a handwheel fastened to the hub; and iii. chain and sprocket means connecting the hub means to the wheel means for moving the carriage along the rails in response to manual rotation of the hub means; and e. lock means for selectively enabling and preventing rotation of the hub means, the lock means comprising:

i. a lock plate held against rotation on the shaft;

ii. pin means translatable within the hub means between a first position whereat the pin means is engaged with the lock plate to prevent rotation of the hub means and a second position whereat the pin means is disengaged from the lock plate to enable rotation of the hub means, wherein the pin means comprises:

a pin having a body that is slidably received within the hub bore means, a neck having a first end joined to the body and a second end, and a head joined to the neck second end; and biasing means interposed between the pin body and the hub bore means for biasing the pin out of the hub bore means; and iii. knob means rotatably captured within the hub means for selectively translating the pin means between the first and second positions thereof, wherein the knob means comprises:

a disk having opposed first and second faces;

a leg extending circumferentially around the disk and being loosely captured between the hub and handwheel for selective manual rotation relative thereto about the shaft longitudinal axis;

ridge means extending along the disk first face for enabling manual rotation of the disk relative to the hub and handwheel; and cam means formed on the disk second face and contacting the pin head for translating the pin between the first and second positions thereof in response to rotation of the disk, so that rotation of the knob means selectively locks the carriage against movement along the rails and enables carriage movement along the rails.

6. The mobile storage system of claim 5 wherein:

a. the knob means leg is fabricated with a cutout that subtends a predetermined angle; and b. a stop pin is pressed into hub and projects into the cutout in the knob means leg to cooperate therewith to define first and second angular positions of the knob means, the pin being in the first position thereof when the knob means is in the first position thereof and the pin being in the second position thereof when the knob means is in the second position thereof.

7. The mobile storage system of claim 6 wherein the knob means cam means defines a first depression that receives the pin head when the knob means is in the first position thereof, and wherein the knob means cam means defines a second depression that is spaced from the first depression in the direction of the shaft longitudinal axis and receives the pin head when the knob means is in the second position thereof, the cam means further defining a ramp between the first and second depressions, so that the pin head is received in a selected one of the knob means cam means depressions in response to rotation of the knob means between the first and second position thereof.

8. In combination with a mobile carriage having a frame, wheels for rollingly supporting the frame on rails, a shaft fixed to the frame and having a longitudinal axis, and a chain and sprocket drive connected to the carriage wheels, means for selectively enabling and preventing movement of the carriage along the rails comprising:

a. hub means rotatably mounted on the shaft in driving association with the chain and sprocket drive for being rotated by a person to move the mobile carriage along the rails;

b. a lock plate stationarily held on the shaft; .

c. pin means received within the hub means for translating between a first position whereat the pin means is disengaged from the lock plate to enable rotation of the hub means on the shaft and a second position whereat the pin means is engaged with the lock plate to prevent rotation of the hub means; and d. a locking knob captured within the hub means and being rotatable about the shaft longitudinal axis relative thereto, the locking knob comprising cam means in contact with the pin means for translating the pin means between the first and second positions thereof in response to rotation of the locking knob.

9. The combination of claim 8 wherein:

a. the hub means comprises a hub rotatable on the shaft and defining a bore having a longitudinal axis at a predetermined radial distance from the shaft longitudinal axis, and a handwheel fastened to the hub; and b. the locking knob is loosely captured between the hub and the handwheel to enable the locking knob to rotate relative thereto.

10. The combination of claim 8 wherein the locking knob further comprises ridge means for being manually grasped to rotate the locking knob relative to the hub means.

11. In combination with a mobile carriage having a frame, wheels for rollingly supporting the frame on rails, a shaft fixed to the frame and having a longitudinal axis, and a chain and sprocket drive connected to the carriage wheels, means for selectively enabling and preventing movement of the carriage along the rails comprising:

a. hub means rotatably mounted on the shaft in driving association with the chain and sprocket drive for being rotated by a person to move the mobile carriage along the rails, wherein the hub means comprises a hub rotatable on the shaft and defining a bore having a longitudinal axis at a predetermined radial distance from the shaft longitudinal axis, and a handwheel fastened to the hub;

b. a lock plate stationarily held on the shaft;

c. pin means received within the hub means for translating between a first position whereat the pin mean is disengaged from the lock plate to enable rotation of the hub means on the shaft and a second position whereat the pin means is engaged with the lock plate to prevent rotation of the hub means; and d. a locking knob captured within the hub means and being rotatable about the shaft longitudinal axis relative thereto, the locking knob comprising cam means in contact with the pin means for translating the pin means between the first and second positions thereof in response to rotation of the locking knob, the locking knob being loosely captured between the hub and the handwheel to enable the locking knob to rotate relative thereto, wherein the pin means comprises:

i. a pin having a body, a head, and a neck interposed between the body and the neck, the pin body being received within the hub bore, the pin head being in contact with the locking knob cam means; and ii. spring means for biasing the pin head against the locking knob cam means.

12. The combination of claim 11 wherein the pin body is disengaged from the lock plate and the pin neck is proximate the lock plate when the pin is in the first position thereof, and wherein the pin body engages the lock plate to thereby prevent rotation of the hub and handwheel when the pin is in the second position thereof.

13. In combination with a mobile carriage having a frame, wheels for rollingly supporting the frame on rails, a shaft fixed to the frame and having a longitudinal axis, and a chain and sprocket drive connected to the carriage wheels, means for selectively enabling and preventing movement of the carriage along the rails comprising:

a. hub means rotatably mounted on the shaft in driving association with the chain and sprocket drive for being rotated by a person to move the mobile carriage along the rails, wherein the hub means comprises a hub rotatable on the shaft and defining a bore having a longitudinal axis at a predetermined radial distance from the shaft longitudinal axis, and a handwheel fastened to the hub;

b. a lock plate stationarily held on the shaft;

c. pin means received within the hub means for translating between a first position whereat the pin means is disengaged from the lock plate to enable rotation of the hub means on the shaft and a second position whereat the pin means is engaged with the lock plate to prevent rotation of the hub means; and d. a locking knob captured within the hub means and being rotatable about the shaft longitudinal axis relative thereto, the locking knob comprising cam means in contact with the pin means for translating the pin means between the first and second positions thereof in response to rotation of the locking knob, wherein the locking knob is loosely captured between the hub and the handwheel to enable the locking knob to rotate relative thereto, and wherein the pin means comprises:

i. a pin having a body, a head, and a neck interposed between the body and the neck, the pin body being received within the hub bore, the pin head being in contact with the locking knob cam means; and ii. spring means for biasing the pin head against the locking knob cam means, wherein the locking knob cam means comprises a cam having first and second angularly spaced depressions dimensioned to receive the pin head, and a ramp extending between the first and second depressions, the depressions being spaced apart in the direction of the shaft longitudinal axis, the pin being in the first position thereof when the pin head is received in the first depression and the pin being in the second position thereof when the pin head is received in the second depression, so that rotating the locking knob causes the pin head to be received in a selected one of the depressions and to thereby translate the pin between the first and second positions thereof.

14. The combination of claim 13 wherein the locking knob is formed with a cutout, and wherein a stop pin is pressed into the hub, the stop pin and locking knob cutout cooperating to define first and second angularly spaced positions of the locking knob relative to the hub and handwheel that correspond with the angular spacing between the first and second depressions, so that rotating the locking knob to the first position thereof relative to the hub and handwheel causes the pin to translate to the first position thereof and rotating the locking knob to the second position thereof relative to the hub and handwheel causes to the pin to translate to the second position thereof.

15. The combination of claim 14 wherein the first and second positions of the locking knob are spaced apart approximately 35 degrees.

16. Apparatus for selectively enabling and preventing a mobile carriage from moving along rails on a floor comprising:

a. wheel means for supporting the mobile carriage on the rails;

b. a shaft immovably fixed to the mobile carriage and having a longitudinal axis;

c. hub means mounted on the shaft for being manually rotated about the shaft longitudinal axis;

d. chain and sprocket means for moving the mobile carriage along the rails in response to rotation of the hub means;

e. a lock plate stationarily held to the shaft;

f. knob means captured in the hub means for being manually rotatable relative thereto between first and second positions; and g. pin means within the hub means and being in contact with the knob means for translating between a first position whereat the pin means is engaged with the lock plate to prevent hub means rotation on the shaft and a second position whereat the pin means is disengaged from the lock plate to enable hub means rotation on the shaft in response to the knob means being rotated to the first and second positions, respectively, thereof.

17. The apparatus of claim 16 wherein the hub means comprises:

a. a hub rotatably mounted on the shaft and having a bore parallel to and at a predetermined radial distance from the shaft longitudinal axis, the pin means being translatable within the hub bore; and b. a handwheel fastened to the hub and cooperating therewith to loosely capture the knob means therebetween, so that the knob means is rotatable relative to the hub and handwheel.

18. The apparatus of claim 17 wherein:

a. the lock plate comprises an annular disk formed with teeth on the periphery thereof;

b. the pin means comprises:

i. a body received in the hub bore, the body being radially aligned with and engaging the teeth of the lock plate when the pin means is in the first position thereof;

ii. a neck joined to the body, the neck being radially aligned with and spaced from the lock plate teeth and the pin means body being out of engagement with the lock plate teeth when the pin means is in the second position thereof;

iii. a head joined to the neck; and iv. spring means within the hub bore for biasing the pin means out of the hub bore and the pin head against the knob means.

19. The apparatus of claim 17 wherein the knob means comprises ridge means for enabling a person to manually rotate the knob means relative to the hub and handwheel.

20. Apparatus for selectively enabling and preventing a mobile carriage from moving along rails on a floor comprising:

a. wheel means for supporting the mobile carriage on the rails;

b. a shaft fixed to the mobile carriage and having a longitudinal axis;

c. hub means mounted on the shaft for being manually rotated about the shaft longitudinal axis;

d. chain and sprocket means for moving the mobile carriage along the rails in response to rotation of the hub means;

e. a lock plate stationarily held to the shaft;

f. knob means captured in the hub means for being manually rotatable relative thereto between first and second positions; and g. pin means within the hub means and being in contact with the knob means for translating between a first position whereat the pin means is engaged with the lock plate to prevent hub means rotation on the shaft and a second position whereat the pin means is disengaged from the lock plate to enable hub means rotation on the shaft in response to the knob means being rotated to the first and second positions, respectively, thereof, wherein the pin means comprises:

i. a pin having a body that is received within the hub means, a neck having one end joined to the body and a second end, and a head joined to the neck second end; and ii. means for biasing the pin head into contact with the knob means.

21. The apparatus of claim 20 wherein:

a. the lock plate is formed generally as a disk with a plurality of teeth extending circumferentially therearound;

b. the pin body is engaged with the lock plate teeth when the pin is in the first position thereof; and c. the pin body is disengaged from the lock plate teeth when the pin is in the second position thereof.

22. Apparatus for selectively enabling and preventing a mobile carriage form moving along rails on a floor comprising:

a. wheel means for supporting the mobile carriage on the rails;

b. a shaft fixed to the mobile carriage and having a longitudinal axis;

c. hub means mounted on the shaft for being manually rotated about the shaft longitudinal axis;

d. chain and sprocket means for moving the mobile carriage along the rails in response to rotation of the hub means;

e. a lock plate stationarily held to the shaft;

f. knob means captured in the hub means for being manually rotatable relative thereto between first and second positions; and g. pin means within the hub means and being in contact with the knob means for translating between a first position whereat the pin means is engaged with the lock plate to prevent hub means rotation on the shaft and a second position whereat the pin means is disengaged from the lock plate to enable hub means rotation on the shaft in response to the knob means being rotated to the first and second positions, respectively, thereof, wherein the knob means comprises cam means in contact with the pin means for translating the pin means between the first and second positions thereof in response to rotation of the knob means between the first and second positions thereof; and wherein the knob means cam means has first and second angularly spaced depressions angularly spaced apart in correlation with the knob means first and second positions, and a ramp surface extending between the first and second depressions, the first and second depressions being contoured to receive the pin means, the depressions being spaced apart in the direction of the shaft longitudinal axis, so that rotation of the knob means between the first and second positions thereof causes the pin means to enter the associated depression and thereby be translated between the pin first and second positions.

23. Apparatus for selectively enabling and preventing a mobile carriage from moving along rails on a floor comprising:

a. wheel means for supporting the mobile carriage on the rails;

b. a shaft fixed to the mobile carriage and having a longitudinal axis;

c. hub means mounted on the shaft for being manually rotated about the shaft longitudinal axis;

d. chain and sprocket means for moving the mobile carriage along the rails in response to rotation of the hub means;

e. a lock plate stationarily held to the shaft;

f. knob means captured in the hub means for being manually rotatable relative thereto between first and second positions; and g. pin means within the hub means and being in contact with the knob means for translating between a first position whereat the pin means is engaged with the lock plate to prevent hub means rotation on the shaft and a second position whereat the pin means is disengaged from the lock plate to enable hub means rotation on the shaft in response to the knob means being rotated to the first and second positions, respectively, thereof, wherein the knob means comprises:

i. disk means loosely captured in the hub means for rotation relative thereto; and ii. cam means formed on the disk means in contact with the pin means for translating the pin means between the first and second positions thereof in response to rotation of the disk means between the first and second positions, respectively, thereof relative to the hub means, and wherein:

the disk means is formed with a cutout that subtends a predetermined angle;

the hub means comprises a stop pin that extends into the disk means cutout to cooperate therewith to define the first and second positions of the knob means; and the disk means cam means comprises two depressions angularly spaced apart a distance substantially equal to the angularly spacing between the disk means first and second positions and a ramp surface extending between the two depressions, the depressions being spaced apart a predetermined distance in the direction of the pin means translation, so that rotation of the disk means between the first and second positions thereof causes the pin means to ride on the cam means ramp surface and enter the corresponding depression and thereby be translated between the first and second positions thereof by the knob means.

24. A method of selectively locking a wheeled carriage against movement comprising the steps of:

a. immovably fixing a shaft with a longitudinal axis to the carriage;

b. mounting a hub and handwheel for rotation on the shaft;

c. providing a drive mechanism between the hub and the carriage wheels;

d. providing a pin translatable within the hub parallel to the shaft longitudinal axis;

e. stationarily holding a lock plate to the shaft;

f. loosely capturing a locking knob between the hub and the handwheel;

g. rotating the locking knob relative to the hub and handwheel to a first position; and h. translating the pin to a first position whereat the pin engages the lock plate to prevent rotation of the hub and handwheel on the shaft and thereby lock the carriage against movement in response to rotating the locking knob to the first position thereof.

25. A method of selectively locking a wheeled carriage against movement comprising the steps of:

a. fixing a shaft with a longitudinal axis to the carriage;

b. mounting a hub and handwheel for rotation on the shaft;

c. providing a drive mechanism between the hub and the carriage wheels;

d. providing a pin translatable within the hub;

e. stationarily holding a lock plate to the shaft;

f. loosely capturing a locking knob between the hub and the handwheel, the locking knob having a cam in contact with the pin;

g. rotating the locking knob to a first position;

h. translating the pin to a first position whereat the pin engages the lock plate to prevent rotation of the hub and handwheel on the shaft and thereby lock the carriage against movement; and i. biasing the pin out of the hub and against the locking knob cam.

26. A method of selectively locking a wheeled carriage against movement comprising the steps of:

a. fixing a shaft with a longitudinal axis to the carriage;

b. mounting a hub and handwheel for rotation on the shaft;

c. providing a drive mechanism between the hub and the carriage wheels;

d. providing a pin having a neck and a body, the pin being translatable within the hub;

e. stationarily holding a lock plate to the shaft;

f. loosely capturing a locking knob between the hub and the handwheel, the locking knob having a cam in contact with the pin;

g. rotating the locking knob to a first position;

h. translating the pin to a first position whereat the pin body is radially aligned with and engages the lock plate to prevent rotation of the hub and handwheel on the shaft and thereby lock the carriage against movement;

i. rotating the locking knob through a predetermined angle from the first position thereof to a second position; and j. translating the pin to disengage the pin body from the lock plate and to radially along the pin neck with and out of engagement with the lock plate to enable the hub and handwheel to rotate and unlock the carriage against movement.

27. The method of claim 26 comprising the further steps of:

a. forming an angular cutout in the locking knob generally subtending the predetermined angle; and b. pressing a stop pin into the hub and projecting into the locking knob angular cutout, so that the stop pin and hub cutout cooperate to limit rotation of the locking knob to the predetermined angle.

* * * * *